US007715754B2

(12) United States Patent
Sato et al.

(10) Patent No.: US 7,715,754 B2
(45) **Date of Patent: *May 11, 2010**

(54) IMAGE FORMING APPARATUS AND CARTRIDGE

(75) Inventors: Shougo Sato, Seto (JP); Naoya Kamimura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/405,419

(22) Filed: Mar. 17, 2009

(65) Prior Publication Data

US 2009/0180797 A1 Jul. 16, 2009

Related U.S. Application Data

(63) Continuation of application No. 11/316,945, filed on Dec. 27, 2005, now Pat. No. 7,526,227.

(30) Foreign Application Priority Data

Dec. 27, 2004 (JP) ..... 2004-378083

(51) Int. Cl.
*G03G 15/00* (2006.01)
*G03G 15/08* (2006.01)
*G03G 15/16* (2006.01)
*G03G 21/18* (2006.01)

(52) U.S. Cl. ..... 399/110; 399/111; 399/119; 399/121

(58) Field of Classification Search ..... 399/110, 399/111, 119, 121
See application file for complete search history.

(56) References Cited

U.S. PATENT DOCUMENTS 6,463,231 B2 10/2002 Numazu et al.
6,647,228 B2 11/2003 Nakamura et al.

(Continued)

FOREIGN PATENT DOCUMENTS

EP 1 406 130 4/2004

(Continued)

OTHER PUBLICATIONS

Japanese Office Action dated Dec. 4, 2007 for Patent Application No. JP2004-378083.

*Primary Examiner*—David M Gray
*Assistant Examiner*—Erika Villaluna
(74) *Attorney, Agent, or Firm*—Banner & Witcoff, Ltd

(57) ABSTRACT

An image forming apparatus includes a belt unit, a plurality of photosensitive drums, a cartridge, a casing, a cartridge holding unit and a first guide unit. The looped belt has a first surface outside of the loop, and is stretched to form a substantially straight portion on the loop that extends in a first direction. The casing has a base surface. The cartridge holding unit holds the cartridge at a first predetermined position in the casing. Each circumferential surface of the plurality of photosensitive drums contacts the straight portion of the first surface when the cartridge is held by the cartridge holding unit at the first predetermined position. The first guide unit guides the cartridge into the first predetermined position, and allows the plurality of photosensitive drums to move apart from the straight portion of the first surface when the cartridge is detached from the first predetermined position.

7 Claims, 8 Drawing Sheets

U.S. PATENT DOCUMENTS

| | | | | |
|---|---|---|---|---|
| 6,708,011 | B2 | 3/2004 | Nomura et al. | |
| 6,721,521 | B2 | 4/2004 | Kataoka et al. | |
| 6,907,209 | B2 | 6/2005 | Abe | |
| 7,526,227 | B2 * | 4/2009 | Sato et al. | 399/110 |
| 2001/0019418 | A1 | 9/2001 | Kataoka et al. | |
| 2004/0022556 | A1 | 2/2004 | Nomura | |
| 2004/0101327 | A1 | 5/2004 | Nomura et al. | |
| 2004/0136747 | A1 | 7/2004 | Tanizaki et al. | |
| 2004/0234287 | A1 | 11/2004 | Nishida et al. | |

FOREIGN PATENT DOCUMENTS

| | | |
|---|---|---|
| JP | 05-307281 | 11/1993 |
| JP | 8-54817 | 2/1996 |
| JP | 08-190245 | 7/1996 |
| JP | 2001-166555 | 6/2001 |
| JP | 2001-242763 | 9/2001 |
| JP | 2001-249517 | 9/2001 |
| JP | 2001-272899 | 10/2001 |
| JP | 2002-132011 | 5/2002 |
| JP | 2002-214874 | 7/2002 |
| JP | 2002-297000 | 10/2002 |
| JP | 2003-15378 | 1/2003 |
| JP | 2003-15497 | 1/2003 |
| JP | 2003-280313 | 10/2003 |
| JP | 2003-280491 | 10/2003 |
| JP | 2003-316104 | 11/2003 |
| JP | 2004-4183 | 1/2004 |
| JP | 2004-61723 | 2/2004 |
| JP | 2004/66611 | 3/2004 |
| JP | 2004-163579 | 6/2004 |
| JP | 2004-258440 | 9/2004 |
| JP | 2005-107109 | 4/2005 |

* cited by examiner

IMAGE FORMING APPARATUS AND CARTRIDGE

RELATED APPLICATIONS

This application is a continuation of U.S. patent application Ser. No. 11/316,945, filed Dec. 27, 2005, which claims priority to Japanese Patent Application No. 2004-378083, filed Dec. 27, 2004, the entire contents of which are incorporated herein by reference.

BACKGROUND OF THE INVENTION

1. Field of the Invention

The present invention relates to an image forming apparatus and a cartridge which can be mounted in the image forming apparatus.

2. Description of Related Art

A tandem type image forming apparatus has photoconductors, exposure units, developing units, and transfer units, each corresponding to the number of colors (for example, four colors of magenta, cyan, yellow and black). When the photoconductors, the developing units, and the like are replaced and maintained, or when a jam process is performed, it is necessary to remove the photoconductors, the developing units, and the like from an image forming apparatus body.

An image forming apparatus disclosed in Japanese unexamined patent application publication No. 2001-272899 has processing units constituted corresponding to the number of colors and guides for sliding the process units. Each processing unit has photoconductors, a developing unit, and the like. Each processing unit is slidable horizontally along each guide to be quickly attached to and detached from the image forming apparatus body. At the time of maintenance or replacement, only a necessary processing unit which requires maintenance or replacement may be removed.

However, in the image forming apparatus, in case of performing a maintenance of a member located inside the processing unit when, for example, a conveying belt for conveying a paper sheet is replaced or a jam process is performed, it is necessary to draw out the processing unit entirely from the image forming apparatus body. Accordingly, the efficiency of the maintenance is low.

Further, the guide is formed to move the processing unit in parallel with the front surface of the conveying belt, etc. Accordingly, in some cases, the photoconductor or the like provided in the processing unit and the conveying belt or the like are slidably contacted with each other to be damaged.

To solve such a problem, an image forming apparatus disclosed in Japanese unexamined patent application publication No. 2003-015378 has a cartridge which is configured of integrated processing units provided corresponding to the number of colors, and is attachable and detachable. According to this image forming apparatus, all of the processing units can be drawn out at a time by drawing the cartridge from the image forming apparatus body. Therefore, its maintenance efficiency is better as compared with the image forming apparatus disclosed in Japanese unexamined patent application publication No. 2001-272899.

Furthermore, after the cartridge is once moved in a direction separating the photoconductor from the belt, the cartridge is drawn out from the image forming apparatus body by sliding the cartridge horizontally with the body. Accordingly, it can prevent the photoconductor and the conveying belt or the like from being brought into slidable contact with each other.

However, since in the image forming apparatus disclosed in Japanese unexamined patent application publication No. 2003-015378, a guiding mechanism, or the like for guiding the cartridge is complicated, its cost is high. Further, since an operation is necessary to separate the photoconductor from the belt before the cartridge is drawn out, its operability or maintenance efficiency is not good.

SUMMARY OF THE INVENTION

In view of the above-described drawbacks, it is an objective of the present invention to provide an image forming apparatus in which, when a cartridge, or the like is attached to and detached from the image forming apparatus, a photoconductor or the like provided in the cartridge is not damaged by slidably contacting with a belt, or the like to achieve good attaching/detaching operability of the cartridge, and a cartridge.

In order to attain the above and other objects, the present invention provides an image forming apparatus including a belt unit, a plurality of photosensitive drums, a plurality of developing units, a transfer unit, a cartridge, a casing, a cartridge holding unit and a first guide unit.

The belt unit includes a looped belt that circularly moves. The looped belt has a first surface outside of the loop and a second surface inside of the loop, and is stretched to form a substantially straight portion on the loop that extends in a first direction. Each of the photosensitive drums has a circumferential surface on which an electrostatic latent image is formable. Each circumferential surface is opposed to the straight portion of the first surface. The plurality of developing units is disposed in one-to-one correspondence with the plurality of photosensitive drums. Each developing unit provides the circumferential surface of the corresponding photosensitive drum with developer in order to form a visible image thereon. The transfer unit is opposed to the straight portion of the second surface. The transfer unit transfers the visible image from the photosensitive drum into either the first surface of the looped belt or a recording medium mounted on the first surface.

The cartridge holds the plurality of photosensitive drums. The casing accommodates the belt unit, the plurality of photosensitive drums, the plurality of developing units and the transfer unit. The cartridge holding unit holds the cartridge at a first predetermined position in the casing. Each circumferential surface of the plurality of photosensitive drums contacts the straight portion of the first surface when the cartridge is held by the cartridge holding unit at the first predetermined position. The first guide unit guides the cartridge into the first predetermined position, and allows the plurality of photosensitive drums to move apart from the straight portion of the first surface when the cartridge is detached from the first predetermined position.

Another aspect of this invention provides a cartridge for use in an image forming device. The image forming device includes a belt unit, a plurality of photosensitive drums, a casing accommodating the belt unit and a first guide unit. The belt unit includes a looped belt that circularly moves. The looped belt has a first surface outside of the loop and a second surface inside of the loop, and is stretched to form a substantially straight portion on the loop that extends in a first direction. Each of the photosensitive drums has a circumferential surface on which an electrostatic latent image is formable. Each circumferential surface is opposed to the straight portion of the first surface. The plurality of photosensitive drums is held by the cartridge. The casing accommodates the belt unit and the plurality of photosensitive drums. The first guide unit guides the cartridge into a first predetermined position.

The cartridge includes a cartridge body and a first projection member that is guided by the first guide unit in order to guide the cartridge into a first predetermined position in the casing. Each circumferential surface of the plurality of photosensitive drums contacts the straight portion of the first surface when the cartridge is held at the first predetermined position, whereas each circumferential surface of the plurality of photosensitive drums moves apart from the straight portion of the first surface when the cartridge is detached from the first predetermined position.

Another aspect of this invention provides a combination of a image forming device and a cartridge.

The image forming device includes a belt unit, a plurality of photosensitive drums, a plurality of developing units, a transfer unit, a casing, a cartridge holding unit, and a first guide unit.

The belt unit includes a looped belt that circularly moves. The looped belt has a first surface outside of the loop and a second surface inside of the loop, and is stretched to form a substantially straight portion on the loop that extends in a first direction. Each of the plurality of photosensitive drums has a circumferential surface on which an electrostatic latent image is formable. Each circumferential surface is opposed to the straight portion of the first surface. The plurality of developing units is disposed in one-to-one correspondence with the plurality of photosensitive drums. Each developing unit provides the circumferential surface of the corresponding photosensitive drum with developer in order to form a visible image thereon. The transfer unit is opposed to the straight portion of the second surface. The transfer unit transfers the visible image from the photosensitive drum into either the first surface of the looped belt or a recording medium mounted on the first surface.

The casing accommodates the belt unit, the plurality of photosensitive drums, the plurality of developing units and the transfer unit. The casing has a base surface. The cartridge holding unit holds the cartridge at a first predetermined position in the casing. Each circumferential surface of the plurality of photosensitive drums contacts the straight portion of the first surface when the cartridge is held by the cartridge holding unit at the first predetermined position. The first guide unit guides the cartridge into the first predetermined position, and allows the plurality of photosensitive drums to move apart from the straight portion of the first surface when the cartridge is detached from the first predetermined position.

The cartridge includes a cartridge body and a first projection member that is guided by the first guide unit in order to guide the cartridge into a first predetermined position in the casing. Each circumferential surface of the plurality of photosensitive drums contacts the straight portion of the first surface when the cartridge is held at the first predetermined position, whereas each circumferential surface of the plurality of photosensitive drums moves apart from the straight portion of the first surface when the cartridge is detached from the first predetermined position.

BRIEF DESCRIPTION OF THE DRAWINGS

The above and other objects, features and advantages of the invention will become more apparent from reading the following description of the preferred embodiments taken in connection with the accompanying drawings in which.

DETAILED DESCRIPTION OF THE PREFERRED EMBODIMENTS

Figure 1:
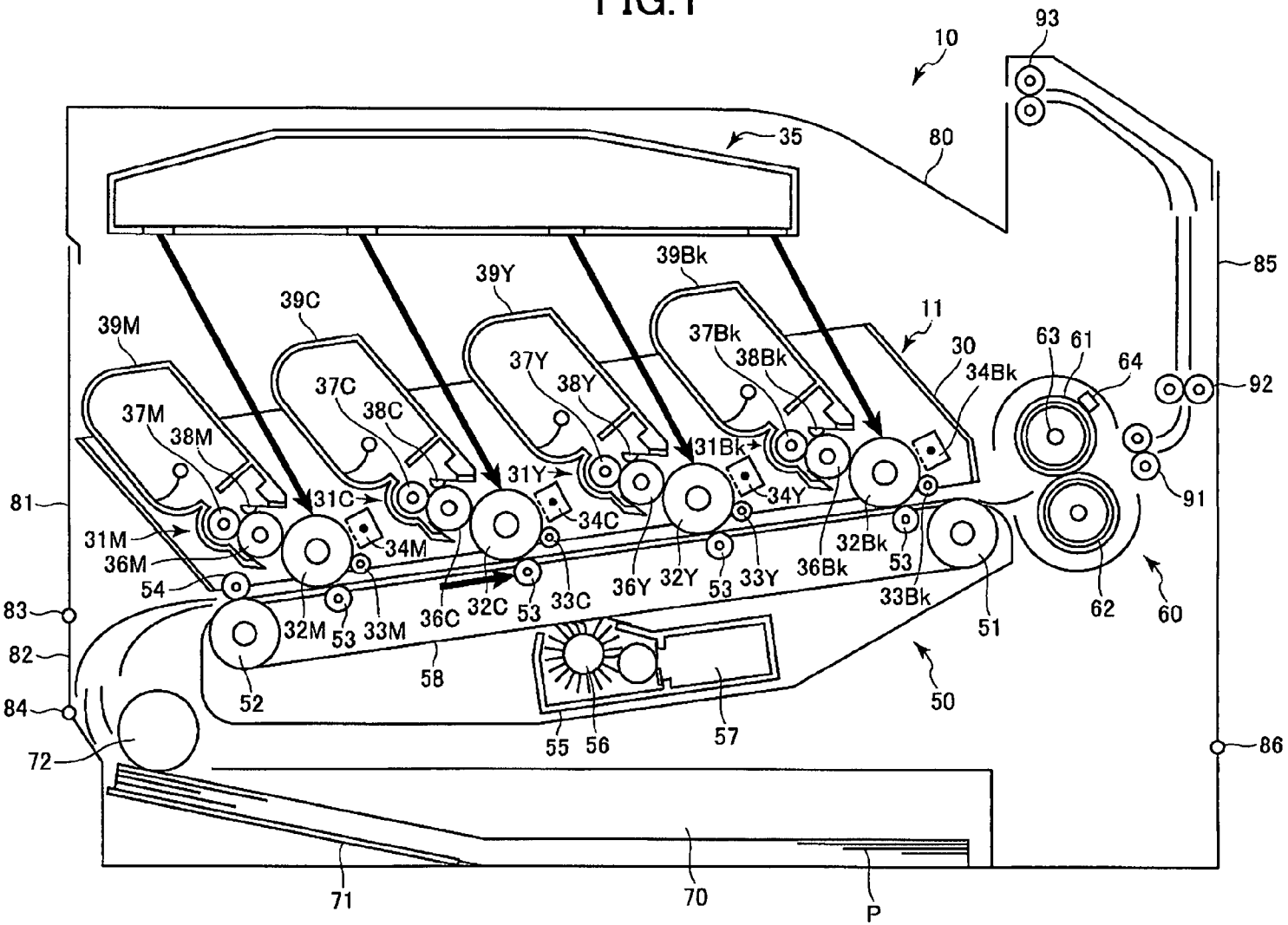
FIG. 1 is a schematic sectional side view showing a printer in a first embodiment.

An image forming apparatus and a cartridge according to the first embodiment of the present invention will be described in detail with reference to the accompanying drawings. FIG. 1 is a schematic sectional side view showing a printer 10 as an image forming apparatus of this embodiment. In the description given below, that the left side in FIG. 1 denotes the front of the printer 10, and the right side denotes the rear thereof.

As shown in FIG. 1, the printer 10 is a tandem type color laser printer. The printer 10 includes a visible image forming unit 11, a cartridge 30, a belt unit 50, a fixing unit 60, a sheet feeding unit 70, a sheet discharge tray 80, and an exposure means 35.

The visible image forming unit 11 has developing units 31M, 31C, 31Y, and 31Bk; photoconductor drums 32M, 32C, 32Y, and 32Bk; cleaning rollers 33M, 33C, 33Y, and 33Bk; and chargers 34M, 34C, 34Y, and 34Bk. The visible image forming unit 11 is held in the cartridge 30. The configuration of the cartridge 30 will be described in detail below.

The developing unit 31M, the photoconductor drum 32M, the cleaning roller 33M, and the charger 34M perform a visible image forming step with a developer of magenta (M). The developing unit 31C, the photoconductor drum 32C, the cleaning roller 33C, and the charger 34C perform a visible image forming step with a developer of cyan (C). The developing unit 31Y, the photoconductor drum 32Y, the cleaning roller 33Y, and the charger 34Y perform a visible image forming step with a developer of yellow (Y). The developing unit 31Bk, the photoconductor drum 32Bk, the cleaning roller 33Bk, and the charger 34Bk perform a visible image forming step with a developer of black (Bk).

In the description given below, as an example, the configurations of the developing unit 31M, the photoconductor drum 32M, the cleaning roller 33M, and the charger 34M which perform the visible image forming step with the developer of magenta (M) will be described. However, the configurations of the developing units 31C, 31Y, and 31Bk, the photoconductor drums 32C, 32Y, and 32Bk, the cleaning rollers 33C, 33Y and 33Bk, and the chargers 34C, 34Y and 34Bk are respectively the same as the configuration of the developing unit 31M, the photoconductor drum 32M, the cleaning roller 33M and the charger 34M.

The developing unit 31M has a developing roller 36M, a supply roller 37M, a layer thickness control blade 38M, and a developing unit case 39M. The developing roller 36M is constituted by forming a coating layer made of resin containing fluorine or made of a rubber material on the front surface of a conductive silicone rubber formed in a columnar shape. In the developing roller 36M, the base material may not always be constituted by a conductive silicone rubber. For example, the base material may be constituted by a conductive urethane rubber. A ten-point height of irregularities (Rz) of the front surface is set to 3 to 5 μm smaller than 9 μm of the average particle diameter of toner.

The supply roller 37M is a conductive sponge roller. The supply roller 37M is located so as to be brought into pressure contact with the developing roller 36M by means of the elastic force of the sponge. As the supply roller 37M, a foam of a suitable member of conductive silicone rubber, an EPDM, a urethane rubber, or the like, can be used.

The base end of the layer thickness control blade 38M is formed in a plate shape and made of a stainless steel, etc. The tip end of the layer thickness control blade 38M is formed of an insulating silicone rubber, an insulating fluorine-containing rubber or resin. The base end of the layer thickness control blade 38M is fixed to the developing unit case 39M. The tip end of the layer thickness control blade 38M is brought into pressure contact with the developing roller 36M on the upper side of the developing roller 36M. In the developing unit case 39M, the toner of magenta (M) color charged positively is contained.

The photoconductor drum 32M has a configuration that a positively chargeable photoconductor layer is formed on a base material made of aluminum, for example. The thickness of the photoconductor layer is 20 μm or more. The base material made of aluminum is used as an earth layer.

The cleaning roller 33M is a roller made of an elastic material, such as a conductive sponge, etc. The cleaning roller 33M is arranged under the photoconductor drum 32M slidably contact with the photoconductor drum 32M.

The charger 34M is a Scorotron type charger. The charger 34M is arranged to face the surface of the photoconductor drum 32M in non-contact manner at the downstream side in the rotating direction of the photoconductor drum 32M from the cleaning roller 33M.

The exposure means 35 is constituted by a known laser scanner unit and arranged above the visible image forming unit 11. The exposure means 35 exposes the surfaces of the photoconductor drums 32M, 32C, 32Y and 32Bk with a laser beam according to image data.

With this configuration, the positively charged toner contained in the developing unit case 39M is supplied to the developing roller 36M by the supply roller 37M. In this case, the toner is made to a uniform thin layer by the layer thickness control blade 38M. On the other hand, the photoconductor layer of the photoconductor drum 32M is charged uniformly by the charger 34M. Then, the photoconductor layer is exposed by the exposure means 35 to form an electrostatic latent image. When the developing roller 36M contacts with the photoconductor drum 32M, the positively charged toner is adhered to an (positively charged) electrostatic latent image formed on the photoconductor drum 32M to develop the electrostatic latent image by an inversion development method.

The sheet feeding unit 70 is provided at the lowermost portion of the image forming apparatus. The sheet feeding unit 70 includes a container tray 71 for containing a paper sheet P, and a pickup roller 72 for feeding out the paper sheet P. The sheet feeding unit 70 is detachable from and attachable to the printer 10 from the front (left side in the drawing). The sheet feeding unit 70 supplies the paper sheet P at a predetermined timing in accordance with the image forming step by the visible image forming unit 11.

The belt unit 50 includes a conveying belt 58, a drive roller 51 and a driven roller 52 for bridging the conveying belt 58. The conveying belt 58 is made of an endless belt and is formed of resin, such as a conductive polycarbonate or a polyimide, in which conductive particles made of carbon, etc., is dispersed. The drive roller 51 is rotatably driven by a motor (not shown) and the driven roller 52 is rotated by following to the drive roller 51 to rotate the conveying belt 58. Further, the driven roller 52 is brought into contact with a primary conveying roller 54. The driven roller 52 cooperates with the primary conveying roller 54 to place the paper sheet P supplied from the sheet feeding unit 70 on the conveying belt 58.

A transfer roller 53 and a compression spring 59 (refer to FIG. 7) are provided near the position opposed to the photoconductor drums 32M, 32C, 32Y and 32Bk inside the conveying belt 58. The transfer roller 53 is biased to the sides of the photoconductor drums 32M, 32C, 32Y, and 32Bk by the elastic force of the compression spring 59. Thus, nips are formed between the conveying belt 58 and the photoconductor drums 32M, 32C, 32Y and 32Bk.

The paper sheet P supplied from the sheet feeding unit 70 is first conveyed to a pressure contact portion between the conveying belt 58 and the primary conveying roller 54. Then, the paper sheet P is sequentially conveyed between the conveying belt 58 and the respective photoconductor drums 32M, 32C, 32Y and 32Bk. When the paper sheet P is passed between the conveying belt 58 and the respective photoconductor drums 32M, 32C, 32Y, and 32Bk, toner images carried by the respective photoconductor drums 32M, 32C, 32Y and 32Bk are sequentially transferred to the paper sheet P. Thus, a color image is formed on the sheet P.

The conveying belt 58 is biased to the sides of the photoconductor drums 32M, 32C, 32Y and 32Bk and is brought into contact with the photoconductor drums. Accordingly, the image is transferred without fail to the paper sheet P from the photoconductor drums 32M, 32C, 32Y and 32Bk.

Furthermore, a cleaning unit 55 is provided at the opposite side to the side where the photoconductor drums 32M, 32C, 32Y and 32B face the conveying belt 58. The cleaning unit 55 includes a scraping member 56 and a casing 57. The toner, dust, or the like adhered to the conveying belt 58 are scraped by the scraping member 56 and contained in the casing 57.

The fixing unit 60 includes a heating roller 61, a pressure roller 62, a heater 63 and a temperature sensor 64. The heating roller 61 is brought into contact with the pressure roller 62. The heating roller 61 and the pressure roller 62 are rotated in the state that the rollers 61 and 62 are brought into contact with each other. The heater 63 is constituted, for example, by a halogen lamp. When the heater 63 is energized, the heater 63 generates heat. The heater 63 is provided inside of the heating roller 61 and raises the temperature of the heating roller 61. Thus, the temperature of the heating roller 61 is controlled to be a heat fixing temperature (for example, 180° C.) during a printing operation. The temperature sensor 64 is constituted, for example, by a thermistor and arranged in contact with the surface of the heating roller 61 to detect the surface temperature of the heating roller 61. The paper sheet P on which the toner image is transferred by the visible image forming unit 11 is heated and pressurized between the heating roller 61 and the pressure roller 62. Then, the toner image is thermally fixed.

The sheet discharge tray 80 is provided at the sheet discharge side of the fixing unit 60. The paper sheet P discharged from the fixing unit 60 is conveyed by the conveying roller pairs 91, 92, and 93 to be contained in the sheet discharge tray 80.

Then, the operation of the printer 10 will be described. First, the photoconductor drums 32M, 32C, 32Y and 32Bk are rotatably driven. In this state, the photoconductor layers on the surfaces of the photoconductor drums 32M, 32C, 32Y and 32Bk are respectively uniformly charged by the chargers 34M, 34C, 34Y and 34Bk. The charged photoconductor layers are exposed corresponding to the respective images of magenta, cyan, yellow and black colors by the exposure means 35. Then, the electrostatic latent images are formed. A magenta toner, cyan toner, yellow toner and black toner are respectively adhered to the electrostatic latent images formed on the photoconductor layers of the photoconductor drums 32M, 32C, 32Y and 32Bk by the magenta developing unit 31M, the cyan developing unit 31C, yellow developing unit 31Y and black developing unit 32Bk. Thus, the electrostatic latent images are respectively developed to the magenta color, the cyan color, the yellow color and the black color.

The toner images of the respective colors formed on the photoconductor layers of the photoconductor drums 32M, 32C, 32Y and 32Bk are transferred to the paper sheet P conveyed by the conveying belt 58. The toner images of the respective colors are formed by providing a slight time difference according to the moving speed of the paper sheet P conveyed by the conveying belt 58 and the positions of the photoconductor drums 32M, 32C, 32Y and 32Bk. Further, the toner images of the respective colors are transferred so as to be superposed on the paper sheet P. Incidentally, the toners remained on the photoconductor drums 32M, 32C, 32Y and 32Bk after the transfer are temporarily held by the cleaning rollers 33M, 33C, 33Y, and 33Bk. The four-color toner images transferred to the paper sheet P are thermally fixed by the fixing unit 60. Thus, a color image is formed on the paper sheet P.

As described above, the visible image forming unit 11 includes the developing units 31M, 31C, 31Y and 31Bk, the photoconductor drums 32M, 32C, 32Y and 32Bk, the cleaning rollers 33M, 33C, 33Y and 33Bk, and the chargers 34M, 34C, 34Y, and 34Bk for the respective visible image forming steps by the respective toners. However, it takes effort if these components are respectively attached to and detached from the body of the printer 10, contributing to low maintenance efficiency.

Therefore, in this embodiment, the visible image forming unit 11 is held in the cartridge 30. The cartridge 30 and the belt unit 50 are easily attached to and detached from the body of the printer 10.

Figure 2:
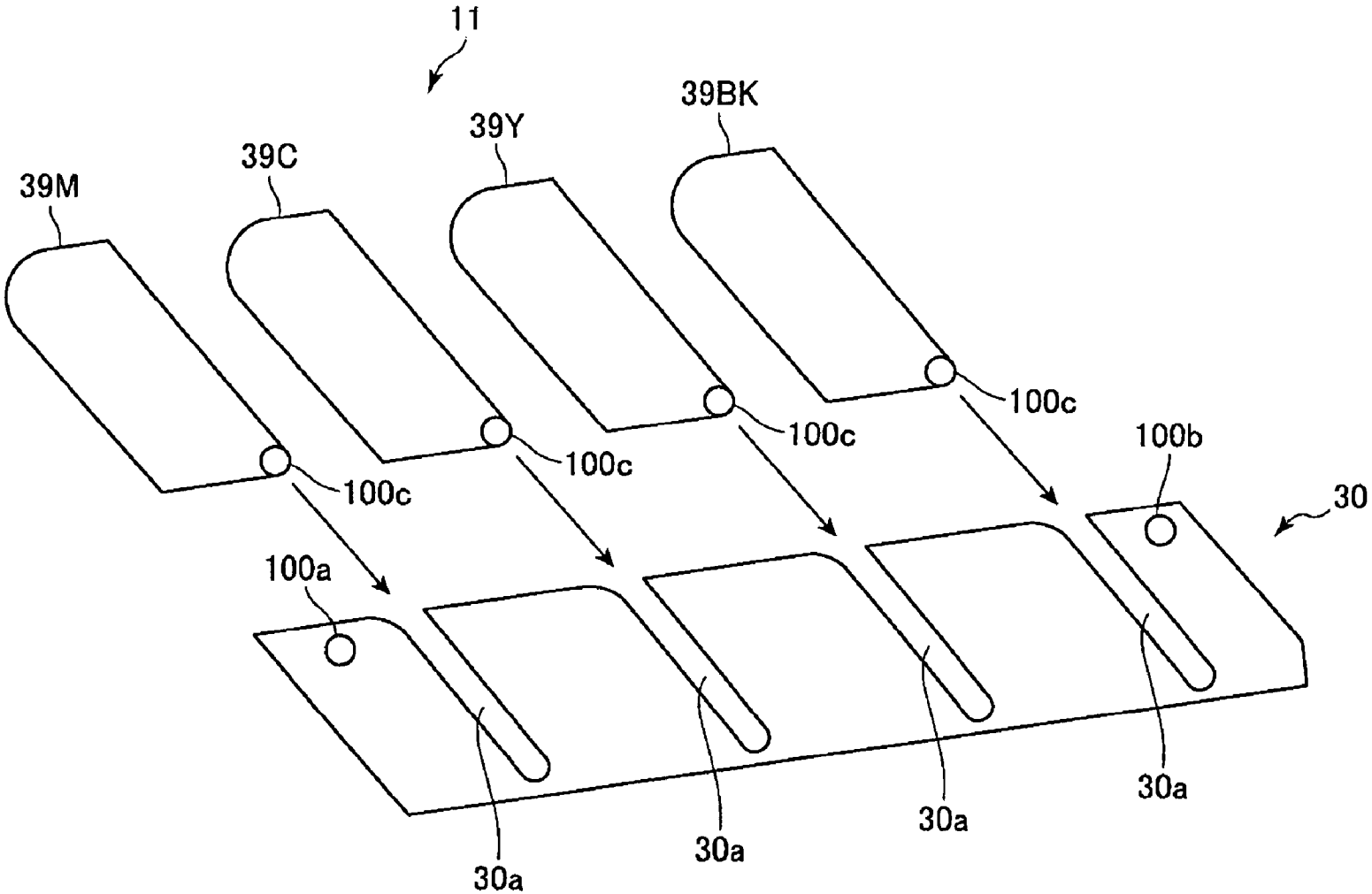
FIG. 2 is a simplified view for explaining the engagement of a visible image forming unit with a cartridge in the first embodiment.

The configuration of the cartridge 30 will be described in detail with reference to FIG. 2. FIG. 2 is a simplified view for explaining the engagement of the visible image forming unit 11 with the cartridge 30. The visible image forming unit 11 that is held by the cartridge 30 is omitted in FIG. 2. The cartridge 30 has a box shape which is opened at the upper surface thereof. In FIG. 2, only one side surface is shown. However, projection members 100*a* and 100*b*, and four engaging grooves 30*a* are respectively provided on both side surfaces (front side and back side of the sheet) of the cartridge 30. The projection members 100*a* and 100*b* are provided at both left and right ends of the cartridge 30 shown in FIG. 2 and are projected to the front side of the sheet (the projection member 100*a* and 100*b* at the side not shown are projected to the back side of the sheet).

Further, though only one side surface is shown in FIG. 2, the engaging projections 100*c* are respectively provided at the lower end on both side surfaces of the developing unit cases 39M, 39C, 39Y and 39Bk for constituting the visible image forming unit 11. The respective engaging projections 100*c* are projected to the front side of the sheet (the engaging projections 100*c* of the side not shown are projected to the back side of the sheet).

Figure 3:
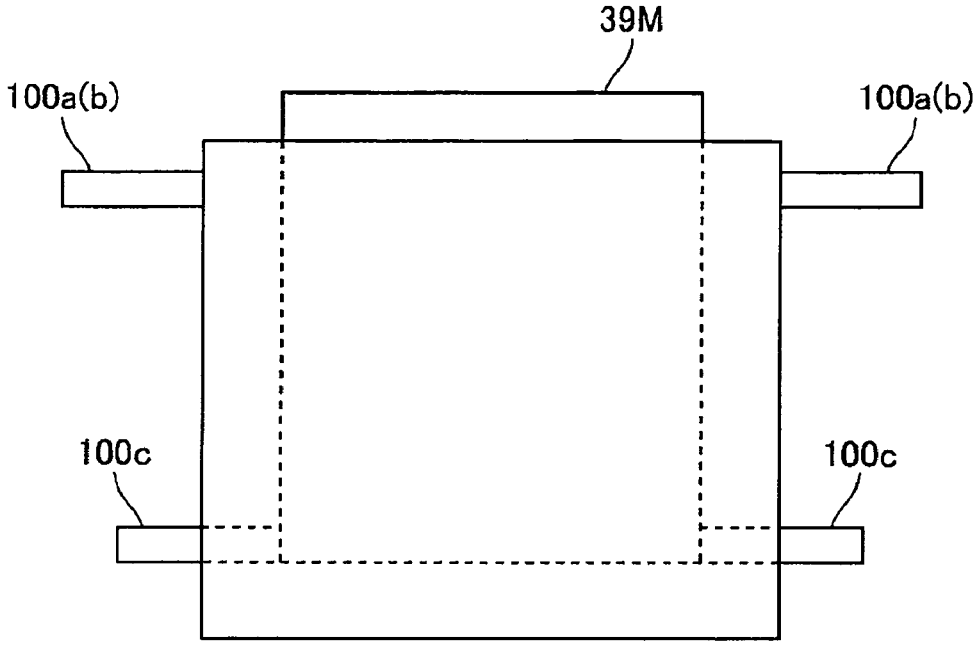
FIG. 3 is a view, as seen from the front, of the state that the visible image forming unit is held in the cartridge in the first embodiment.

The engaging projections 100*c* of the respective developing unit cases 39M, 39C, 39Y and 39Bk are respectively engaged with the four engaging grooves 30*a* of the cartridge. Thus, the visible image forming unit 11 is held in the cartridge 30. FIG. 3 is a view showing the state that the visible image forming unit 11 is held in the cartridge 30 as seen from the front (left side of FIG. 1). As shown in FIG. 3, in the state that the visible image forming unit 11 (the developing unit cases 39M) is held in the cartridge 30, the projection members 100*a* and 100*b* are projected more to the side surface side than the engaging projections 100*c*.

Figure 4:
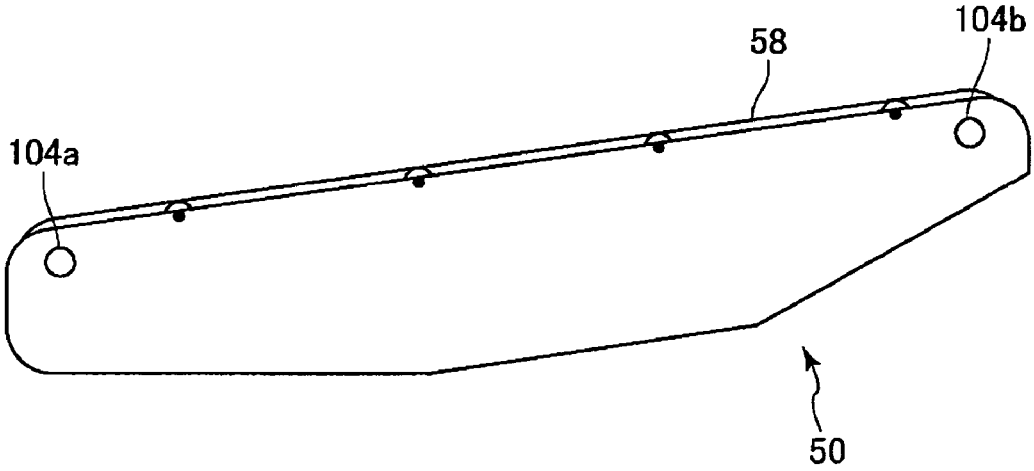
FIG. 4 is a side view of a belt unit in the first embodiment.

FIG. 4 is a side view of the belt unit 50. Though only one side surface is shown in FIG. 4, the supporting members 104*a* and 104*b* that are respectively shafts of the drive roller 51 and the driven roller 52 are provided to the both the side surfaces (the front side and back side of the sheet) of the belt unit 50. The supporting members 104*a* and 104*b* are provided at the left and right ends in the drawing, and projected to the front side of the sheet (the supporting members 104*a* and 104*b* of the side not shown are projected to the back side of the sheet).

Figure 5:
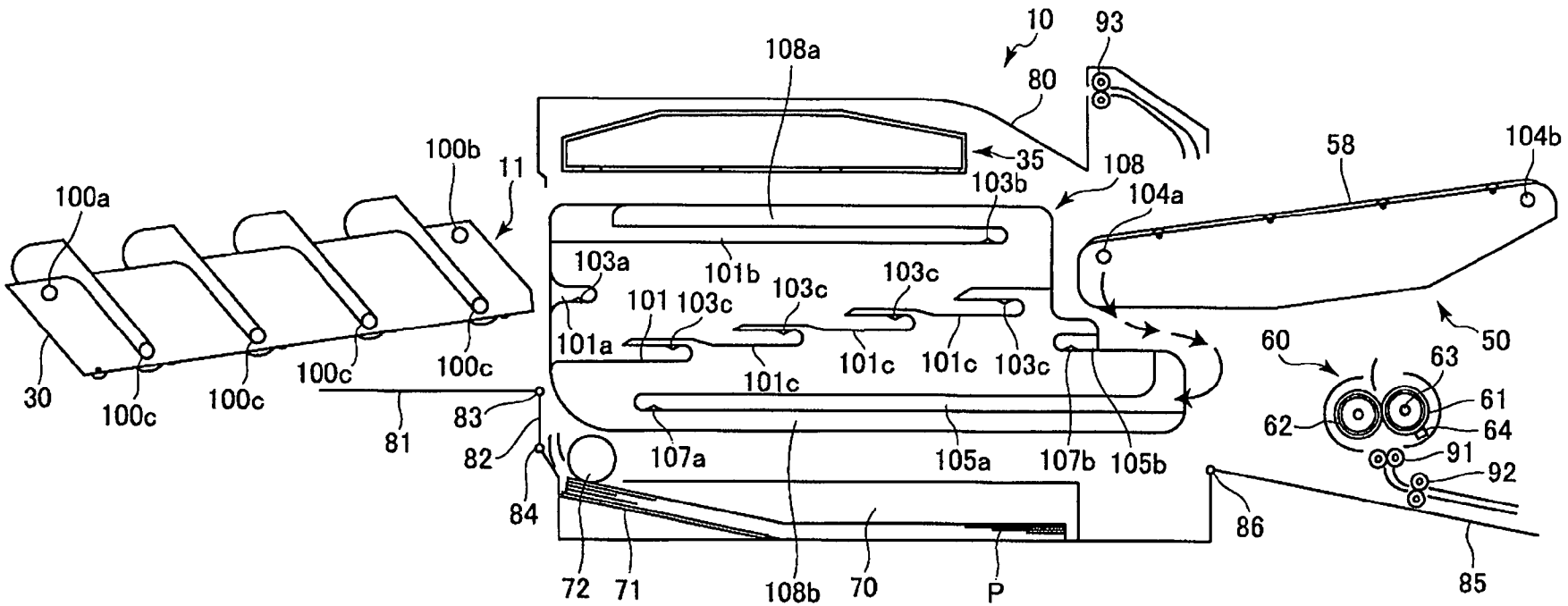
FIG. 5 is an explanatory view for explaining the attaching and detaching operation of the cartridge and the belt unit with respect to the printer according to the first embodiment.
Figure 6:
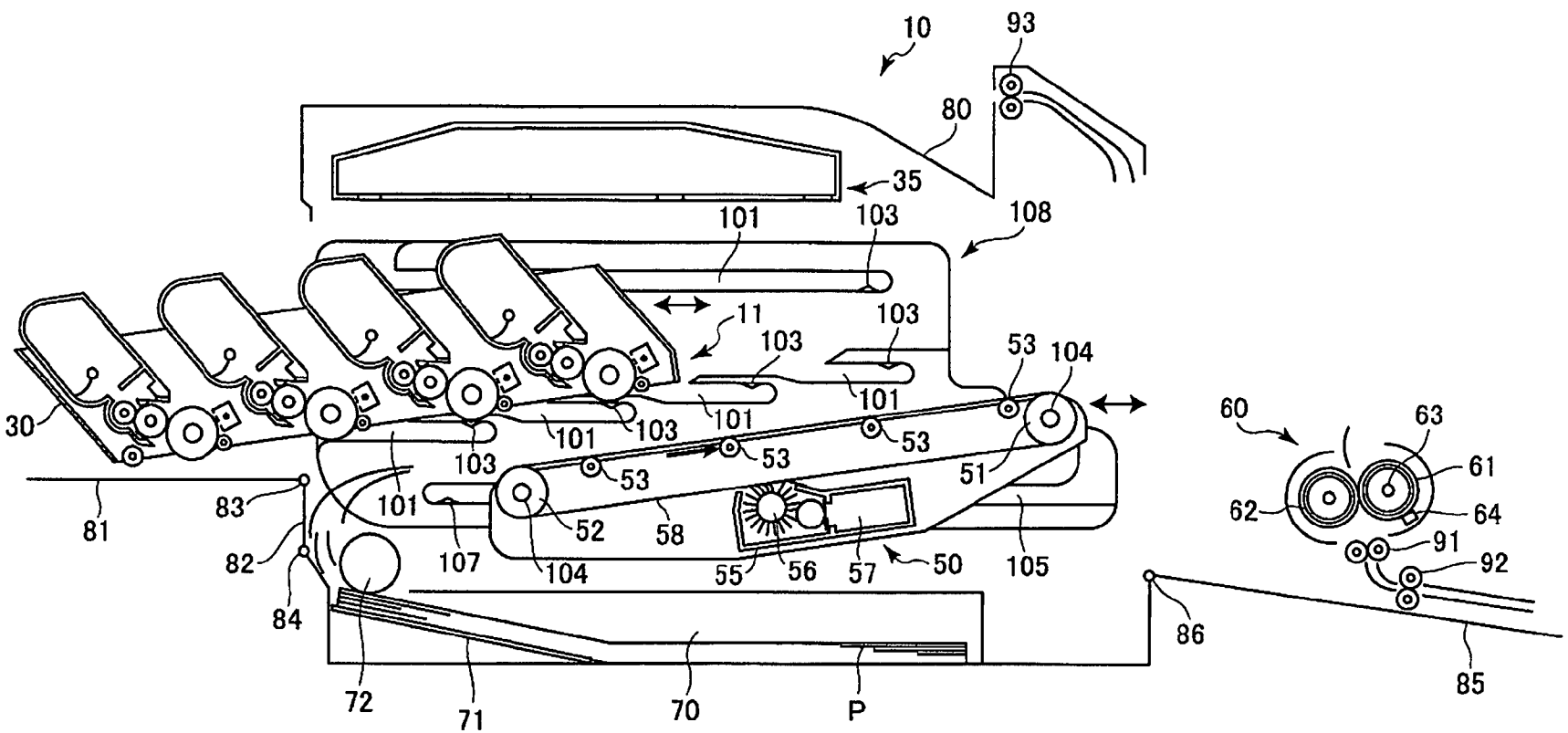
FIG. 6 is another explanatory view for explaining the attaching and detaching operation of the cartridge and the belt unit with respect to the printer according to the first embodiment.

FIG. 5 and FIG. 6 are views for explaining the attachment and detachment of the cartridge 30 and the belt unit 50 to/from the printer 10. A guiding mechanism 108 is provided in the printer 10. The guiding mechanism 108 includes a pair of guide plates 108*a* and a pair of guide plates 108*b*. That is, from the front side of the sheet, the guide plate 108*a*, the guide plate 108*b*, the guide plate 108*b*, and the guide plate 108*a* are sequentially arranged substantially in parallel with each other. Though the guide plates 108*a* and the guide plate 108*b* of the front side of the sheet are omitted in FIG. 5 and FIG. 6, the cartridge 30 and the belt unit 50 are attachable to and detachable from the printer 10 same as the guide plates 108*a* and the guide plate 108*b* of the back side of the sheet are.

In the guide plate 108*a*, a guide groove 101*a* in which the projection member 100*a* of the cartridge 30 is inserted, and a guide groove 101*b* in which the projection member 100*b* of the cartridge 30 is inserted, are formed. In FIG. 5, the projection members 100*a* and 100*b* of the back side of the sheet are inserted to the guide grooves 101*a* and 101*b* respectively. The projection members 100*a* and 100*b* are guided substantially horizontally from the front end (left end in the drawing) of the guiding mechanism 108 in the inside of the printer 10 along the guide grooves 101*a* and 101*b*. Further, locking members 103*a* and 103*b* are respectively formed on the guide grooves 101*a* and 101*b*. The projection members 100*a* and 100*b* respectively inserted into the guiding grooves 101*a* and 101*b* are respectively elastically locked by the locking members 103*a* and 103*b*.

In the guide plate 108*b*, four guide grooves 101*c* in which the four engaging projections 100*c* of the cartridge 30 are respectively inserted, are formed. The four engaging projections 100*c* are respectively guided from the front end (left end in the drawing) of the guiding mechanism 108 substantially horizontally into the inside of the printer 10 along the four guide grooves 101*c*. Furthermore, the locking members 103*c* are formed in the respective guide grooves 101*c*. The engaging projections 100*c* inserted into the guide grooves 101*c* are respectively locked elastically by the locking members 103*c*.

In the state that the visible image forming unit 11 is held in the cartridge 30, the engaging projections 100*c* are not projected more to the side of the side surface than the projection members 100*a* and 100*b*. Accordingly, the engaging projections 100*c* are not collided with the guide plate 108*a*, but inserted into the guide grooves 101*c*. Thus, the cartridge 30 is fixed to the body of the printer 10.

Further, the guide plate 108*b* is formed with a guide groove 105*a* in which the supporting member 104*a* of the belt unit 50 is inserted, and a guide groove 105*b* in which the supporting member 104*b* of the belt unit 50 is inserted. The supporting members 104*a* and 104*b* are guided from the rear front end (right end in the drawing) of the guiding mechanism 108 substantially horizontally into the printer 10. Moreover, locking members 107*a* and 107*b* are respectively formed in the guide grooves 105*a* and 105*b*. The supporting members 104*a* and 104*b* respectively inserted into the guide grooves 105*a* and 105*b* are elastically locked by the locking members 107*a* and 107*b*. The supporting members 104*a* and 104*b* are projected in substantially the same length as the engaging projections 100*c* of the cartridge 30. Accordingly, the supporting members 104*a* and 104*b* are not collided with the guide plates 108*a*, but inserted into the guide grooves 105*a* and 105*b*.

Since the belt unit 50 is fixed to the body of the printer 10, the cartridge 30 and the belt unit 50 can be drawn (removed) from the body of the printer 10 by applying a force against the elastic force of the locking members 103*a* and 103*b* and 107*a* and 107*b*.

Thus, the drawing directions of the cartridge 30 and the belt unit 50 are in a substantially horizontal direction and the force for moving the cartridge 30 and the belt unit 50 in a vertical direction is hardly required. Accordingly, the cartridge 30 and the belt unit 50 can be operated with lighter force. The cartridge 30 and the belt unit 50 are positioned at predetermined positions by the guiding mechanism 108. Therefore, displacement (transfer deviation) when an image is transferred can be prevented. The cartridge 30 and the belt unit 50 are drawn in opposite directions. That is, the cartridge 30 and the belt unit 50 can be drawn independently from each other. Thus, after the cartridge 30 is drawn out, it takes no effort to draw out of the belt unit 50. The maintenance efficiency is good.

The guide grooves 101*a*, 101*b*, 101*c* and 105*a*, 105*b* are arranged so that the cartridge 30 and the belt unit 50 are oblique to the horizontal plane and the extending direction of the conveying belt 58 and the aligning direction of the photoconductor drums 32M, 32C, 32Y and 32Bk are parallel to each other. The extending direction is a direction perpendicular to the supporting shafts of the drive roller 51 and the driven roller 52 located at both ends of the circumferential surface facing the photoconductor drums 32M, 32C, 32Y and 32Bk of the circumferential surface of the conveying belt 58, and directed from the one supporting shaft toward the other supporting shaft.

A front cover 81, a front lower cover 82, a supporting shaft 83 and a supporting shaft 84 are provided at the front (left end of the drawing) of the printer 10. The front cover 81 is supported by the supporting shaft 83. The front lower cover 82 is supported by the supporting shaft 84. The front cover 81 and the front lower cover 82 are freely opened and closed. The cartridge 30 is detachable from and attachable to the body of the printer 10 by opening and closing the front cover 81 and the front lower cover 82.

A rear cover 85 and a supporting shaft 86 are provided at the back of the printer 10. The rear cover 85 is supported by the supporting shaft 86 and is freely opened and closed. The belt unit 50 is attachable to and detachable from the body of the printer 10 by opening and closing the rear cover 85. The above-mentioned fixing unit 60, and the conveying rollers 91 and 92 are provided at the rear cover 85. When the rear cover 85 is closed, the fixing unit 60 and the conveying rollers 91 and 92 block the attaching and detaching path of the belt unit 50 as shown in FIG. 1. However, when the rear cover 85 is opened, as shown in FIG. 5, the fixing unit 60 and the conveying rollers 91 and 92 are released from the attaching and detaching path of the belt unit 50. Therefore, when the rear cover 85 is opened, the belt unit 50 can be attached to and detached from the body of the printer 10.

Figure 7A:
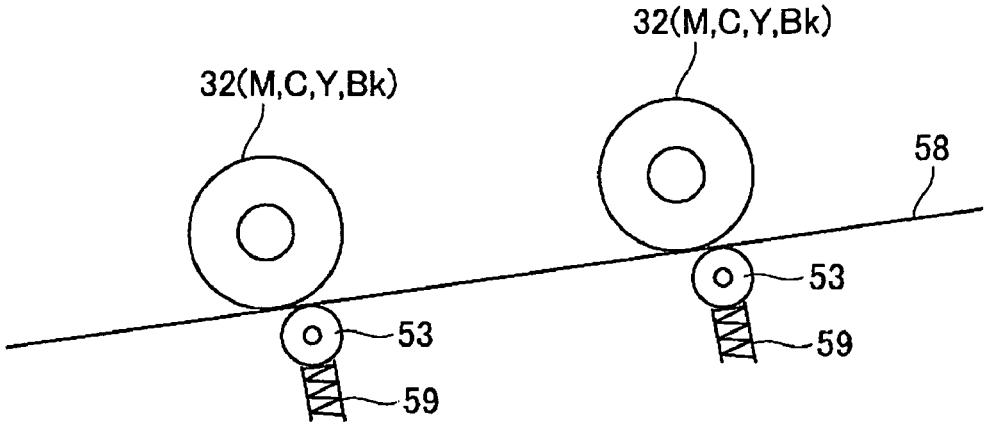
FIGS. 7A and 7B are enlarged views of contact portions of the photoconductor drums with the conveying belt in the first embodiment.
Figure 7B:
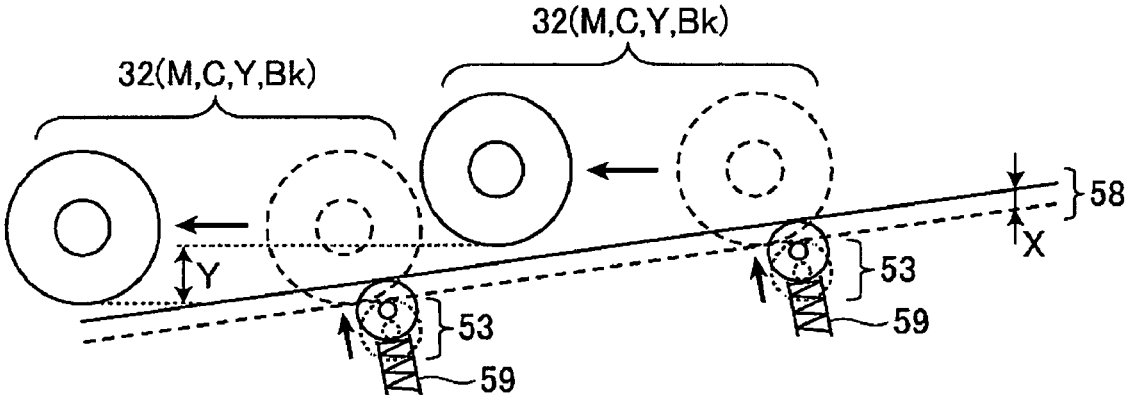

When the cartridge 30 and the belt unit 50 are attached to and detached from the printer 10, the photoconductor drums 32M, 32C, 32Y and 32Bk loaded in the cartridge 30 and the conveying belt 58 included in the belt unit 50 are brought into contact with one another or separated from one another. The detail will be described by using FIG. 7(*a*) and FIG. 7(*b*). FIG. 7(*a*) and FIG. 7(*b*) are enlarged views of the contact portions of the conveying belt 58 with the photoconductor drums 32M, 32C, 32Y and 32Bk. Incidentally, the configuration is as described above.

When the cartridge 30 and the belt unit 50 are contained in the body of the printer 10, as shown in FIG. 7(*a*), the contact state of the photoconductor drums 32M, 32C, 32Y and 32Bk with the conveying belt 58 is held by the compression spring 59 and the transfer rollers 53.

When the cartridge 30 is drawn from the body of the printer 10 in a substantially horizontal direction, as shown in FIG. 7(*b*), the contact of the photoconductor drums 32M, 32C, 32Y and 32Bk with the conveying belt 58 is released, and the photoconductor drums 32M, 32C, 32Y and 32Bk are separated from the conveying belt 58. On the other hand, the transfer rollers 53 are not brought into contact with the photoconductor drums 32M, 32C, 32Y and 32Bk. Accordingly, the transfer rollers 53 are moved upward by the elastic force of the compression spring 59. Thus, the conveying belt 58 rises upward.

In this embodiment, the cartridge 30 and the belt unit 50 are arranged obliquely to separate from each other when the cartridge 30 and the belt unit 50 are drawn from the body of the printer 10. That is, the photoconductor drums 32M, 32C, 32Y and 32Bk and the conveying belt 58 are arranged in parallel with one another and at a predetermined angle to the drawing direction of the cartridge 30. The angle is an angle for separating the photoconductor drums 32M, 32C, 32Y and 32Bk and the conveying belt 58 when the cartridge 30 is drawn out. That is, when the cartridge 30 is drawn out from the body of the printer 10, the rise height X of the conveying belt 58 is set to be smaller than the deviation Y of the lower end position of the respective photoconductor drums 32M, 32C, 32Y and 32Bk adjacent in the longitudinal direction.

Therefore, even if the conveying belt 58 rises when the cartridge 30 is drawn out, an interval can be held between the photoconductor drums 32M, 32C, 32Y and 32Bk and the conveying belt 58. Thus, the photoconductor drums 32M, 32C, 32Y and 32Bk can be certainly prevented from being damaged in contact with the expanded conveying belt 58. Furthermore, when the photoconductor drums 32M, 32C, 32Y and 32Bk are separated from the conveying belt 58, a guide for guiding the cartridge 30 in the separating direction and a complicated mechanism for moving the cartridge 30 in a separating direction are not required. Accordingly, the printer 10 can be manufactured at lower cost.

As described above, in the printer 10 of this embodiment, the constituting element of the visible image forming unit 11 is held integrally in the cartridge 30. Accordingly, the cartridge 30 becomes attachable and detachable by sliding the cartridge 30 along the guiding mechanism 108 provided in the printer 10. Similarly, the belt unit 50 is constituted to be attachable and detachable. The cartridge 30 and the belt unit 50 can be easily attached to and detached from the body of the printer 10. Therefore, the maintenance efficiency can be improved.

Further, the sheet feeding unit 70 is constituted to be able to be drawn out in the same direction as the cartridge 30 or to be mounted. Accordingly, the usability and maintenance efficiency can be improved.

Figure 8:
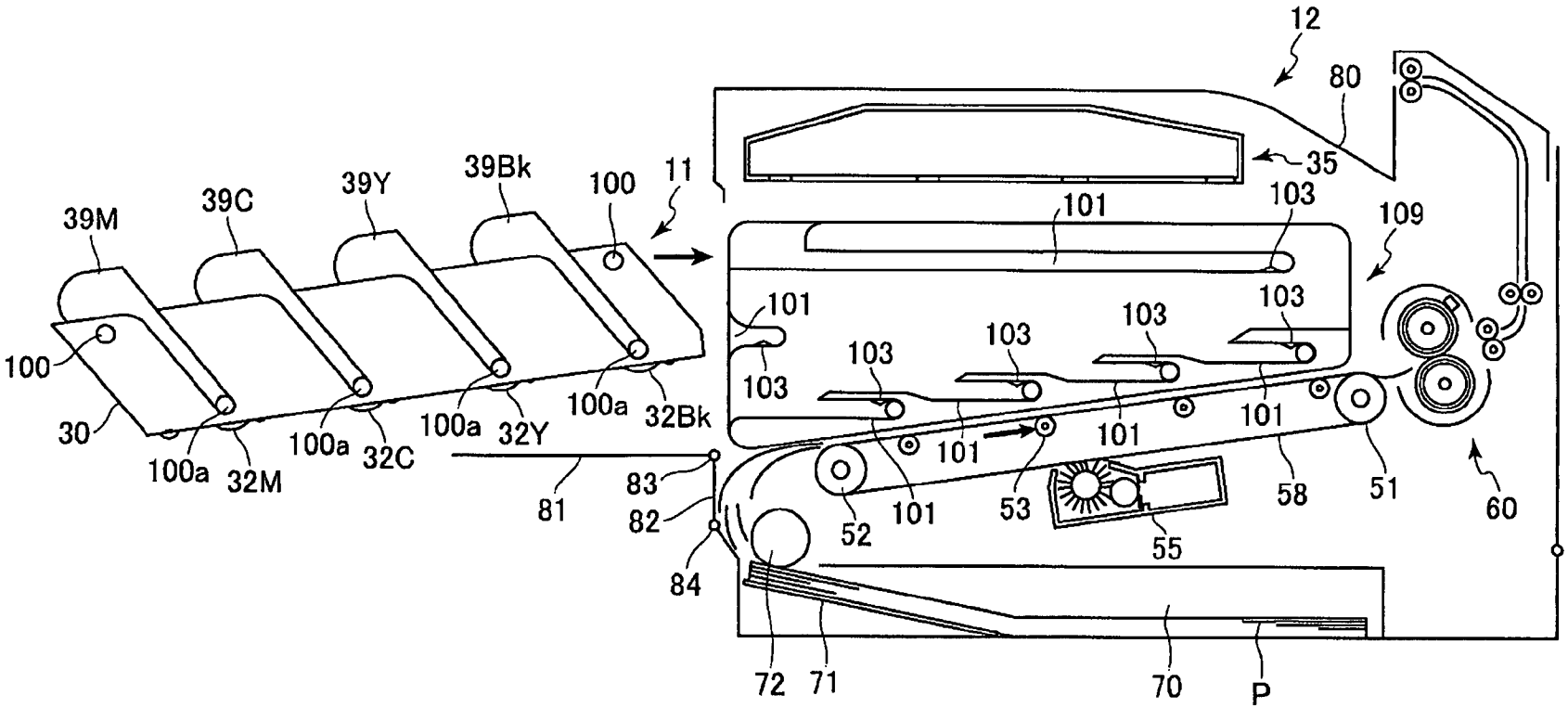
FIG. 8 is a schematic sectional side view showing a printer in a second embodiment.

Next, a printer 12 according to the second embodiment of the present invention will be described by using FIG. 8. As shown in FIG. 8, in this embodiment, a conveying belt 58, a drive roller 51, a driven roller 52, and a cleaning unit 55 are arranged fixedly in the body of the printer 12. Further, the cartridge 30 is constituted to be detachable and attachable by a guiding mechanism 109 provided in the body of the printer 10 as in the first embodiment.

According to such a constitution, the conveying belt 58 is fixed to the body of the printer 12. The belt unit 50 can suppress the displacement (transfer deviation) of an image as compared with the first embodiment in which the belt unit 50 is detachable from and attachable to the body. Thus, the image of higher quality can be formed.

Figure 9:
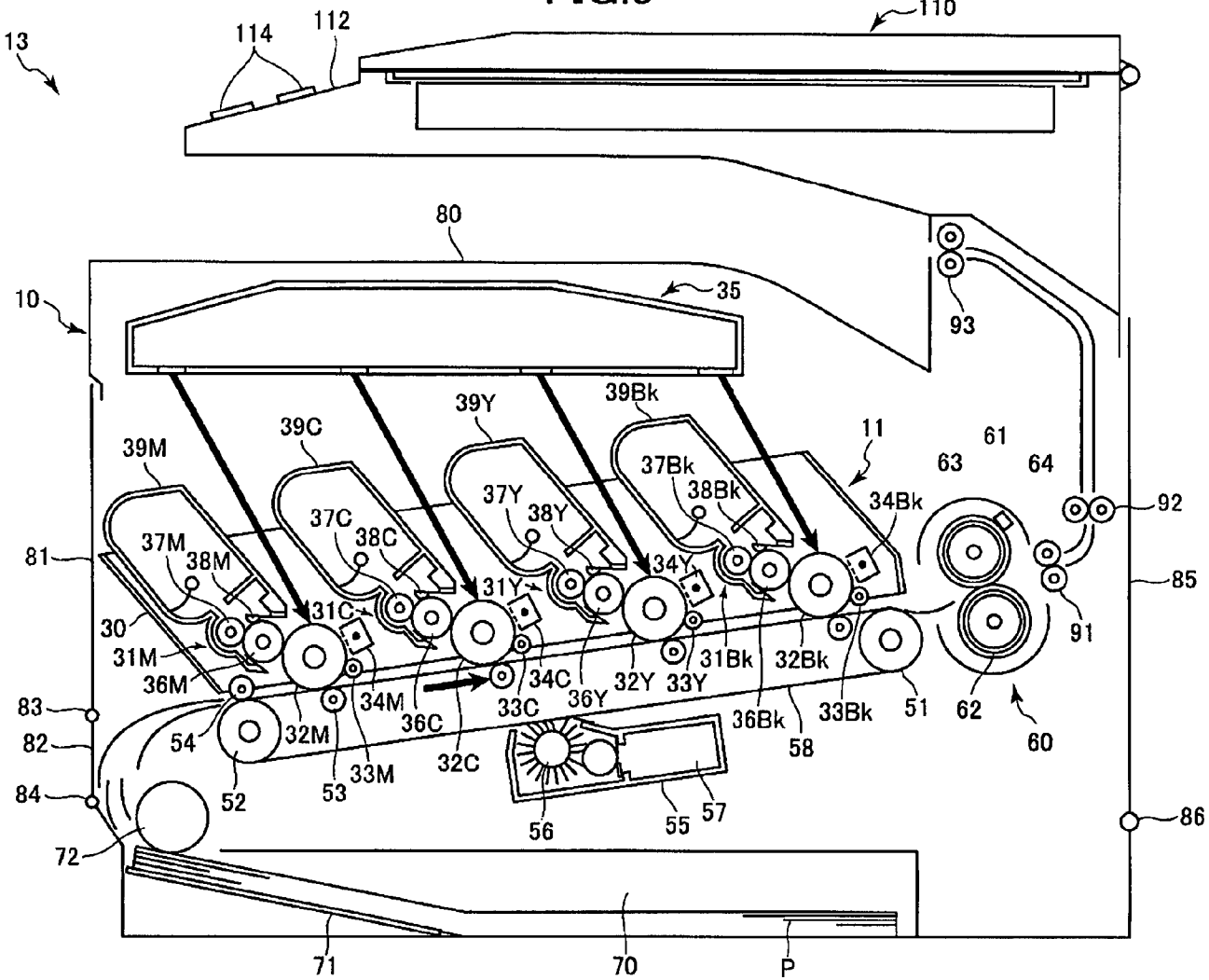
FIG. 9 is a schematic sectional side view showing a complex machine in a third embodiment.

Next, a complex machine 13 of the third embodiment of the present invention will be described by using FIG. 9. In this embodiment, as shown in FIG. 9, a scanner unit 110 is provided integrally at an upper portion above the printer 10 so as to become parallel to the bottom of the complex machine 13. Further, the scanner unit 110 includes an operation panel 112 having an operating unit 114, or the like for operating the scanner unit 110 and the printer 10. The other constitution of the complex machine 13 of this embodiment is similar to the printer 10 in the first embodiment. Thus, the description thereof will be omitted.

According to such a configuration, the scanner unit 110 is provided above the printer 10. An image can be easily read and printed. Thus, the printer device having good usability can be provided. Further, the photoconductor drums 32M, 32C, 32Y and 32Bk are arranged so that the adjacent photoconductor drums 32 overlap with one another in the horizontal direction. Accordingly, as compared with the case that the photoconductor drums 32M, 32C, 32Y and 32Bk are arranged in the vertical direction, the height of the printer 10 can be lowered. Therefore, when the printer 10 or the complex machine 13 is provided, it is easy to constitute the printer 10 or the complex machine 13 in height easy to be handled by a user. Further, since the center of gravity is lowered, the printer 10 or the complex machine 13 can be installed stably.

The scanner unit 110 is provided in parallel with the bottom of the printer device, that is, substantially horizontally. Accordingly, when the cartridge 30 is drawn from the body of the printer 10, the cartridge 30 can be smoothly drawn out without interfering with the scanner unit 110.

Further, the sheet discharge tray 80 for containing a medium to be recorded in which an image is transferred is provided between the scanner unit 110 and the printer 10. Accordingly, as compared with the case that the sheet discharge tray 80 is provided at the one of the longitudinal ends of the body of the image forming apparatus or one of the left and right ends, etc., of the body of the image forming apparatus, the sheet discharge tray 80 is not projected from the image forming apparatus. Thus, space saving can be achieved. Furthermore, since the sheet discharge tray 80 is not projected from the image forming apparatus, the space to be occupied by the image forming apparatus can be narrowed. Moreover, an operation panel 112 having an operating unit 114 which can be operated by a user is provided near the scanner unit 110. Thus, as compared with the case that the operation panel 112 is arranged on the outer wall of the printer 10, the operability is improved.

While the invention has been described in detail with reference to the specific embodiment thereof, it would be apparent to those skilled in the art that various changes and modifications may be made therein without departing from the spirit of the invention. For example, in the above embodiments, the printer of the direct transfer type for transferring an image to the paper sheet P directly from the respective photoconductor drums 32M, 32C, 32Y and 32Bk has been described. However, if the present invention is applied to a printer of the intermediate transfer type for transferring an image to the intermediate transfer belt to transfer the image on a paper sheet, the similar effect can be obtained.

Further, in the above respective embodiments, the conveying belt 58 extends between the drive roller 51 and the driven roller 52, and the extending direction is one direction. However, for example, if the conveying belt 58 extends between three or more rollers and the extending direction is two or more directions, the present invention can be applied, and the similar effect can be obtained. The extending direction in this case is a direction vertical to the supporting shafts of the rollers located at both ends of a circumferential surface facing the photoconductor drums 32M, 32C, 32Y and 32Bk of the circumferential surface of the conveying belt 58, and directed from the supporting shaft of one roller to the supporting shaft of the other roller.

Moreover, in the above-mentioned embodiments, the belt unit 50 is arranged under the cartridge 30. However, the belt unit 50 may be arranged above the cartridge 30. With this configuration, the opening of the developing unit case 39 can be directed upward. Accordingly, the toner is prevented from leaking downward.

In the above-mentioned embodiment, when the cartridge 30 or the belt unit 50 is drawn out to a predetermined position, the cartridge 30 or the belt unit 50 is removed from the body of the printer 10. Alternatively, when the cartridge 30 or the belt unit 50 is drawn to a predetermined position, a stopping member for once stopping the cartridge or the belt unit at the predetermined position may be provided.

In the first embodiment, the fixing unit 60 is provided to the rear cover 85 of the printer 10. Alternatively, the fixing unit 60 may be provided to the belt unit 50, and the fixing unit 60 and the belt unit 50 may be collectively attached to or detached from the body of the printer 10. Further, the fixing unit 60 may be constituted so that the fixing unit 60 is individually attached to and detached from the body of the printer 10.

What is claimed is:

1. An image forming apparatus comprising:

a belt unit including a looped belt that circularly moves, the looped belt having a first surface outside of the loop and a second surface inside of the loop, and being stretched to form a substantially straight portion on the loop that extends in a first direction;

a plurality of photosensitive drums, each having a circumferential surface on which an electrostatic latent image is formable, each circumferential surface being opposed to the straight portion of the first surface;

a plurality of developing units disposed in one-to-one correspondence with the plurality of photosensitive drums, wherein each developing unit provides the circumferential surface of the corresponding photosensitive drum with developer in order to form a visible image thereon;

a transfer unit opposed to the straight portion of the second surface, wherein the transfer unit transfers the visible image from the photosensitive drum onto either the first surface of the looped belt or a recording medium mounted on the first surface;

a drum unit that holds the plurality of photosensitive drums and has a first projection member;

a body accommodating the belt unit, the plurality of photosensitive drums, the plurality of developing units and the transfer unit, having a base surface extending in a second direction, and having a first predetermined position, a second predetermined position, and a third predetermined position;

a drum unit holding unit that holds the drum unit at the first predetermined position, wherein each circumferential surface of the plurality of photosensitive drums contacts the straight portion of the first surface when the drum unit is held by the drum unit holding unit at the first predetermined position;

a first guide unit that guides the first projection member to move the drum unit into the first predetermined position, and guides the first projection member in the second direction to move the plurality of photosensitive drums apart from the straight portion of the first surface when the drum unit is apart from the first predetermined position;

a second guide unit that guides the belt unit into the second predetermined position, and guides the belt unit in a third direction opposite to the second direction when the belt unit is detached from the second predetermined position; and a cassette unit detachably provided at the third predetermined position to accommodate a recording medium on which an image is to be formed, the cassette unit being configured to be detachable from the third predetermined position in the first direction.

2. The image forming apparatus according to claim 1, further comprising:

a cover provided on the body, the belt unit being configured to be detachable from the second predetermined position when the cover is opened; and a fixing unit fixing the visible image to a recording medium, and attached to the cover to move in conjunction with opening and closing the cover.

3. The image forming apparatus according to claim 2, further comprising:

a discharge tray provided on or above the body and on which a recording medium on which an image has been formed is stacked; and a pair of conveying rollers attached to the cover to move in conjunction with the opening and closing of the cover.

4. The image forming apparatus according to claim 1, wherein the photosensitive drum has a second projection member guided by the first guide unit to move the drum unit into the first predetermined position.

5. The image forming apparatus according to claim 1, further comprising a bias unit that biases the first surface of the looped belt toward the photosensitive drum, wherein the first guide unit guides the first projection member to detach the drum unit from the first position without contacting the plurality of the photosensitive drums with the first surface that has moved toward the photosensitive drums.

6. The image forming apparatus according to claim 1, further comprising:

an image reading unit mounted on or above the body to read an image formed on the recording medium and produce image data based on the image; and a latent image forming unit that forms the latent image on the photosensitive drum based on the image data produced by the image reading unit;

wherein the plurality of photosensitive drums is arranged so that adjacent photosensitive drums overlap as viewed from the first direction.

7. The image forming apparatus according to claim 6, further comprising a recording medium receiving section disposed between the body and the image reading unit to receive a recording medium on which an image has been formed.

* * * * *